US007770291B2

(12) United States Patent
Claus et al.

(10) Patent No.: US 7,770,291 B2
(45) Date of Patent: Aug. 10, 2010

(54) INTERNAL COMBUSTION ENGINE COMPONENT AND METHOD FOR THE PRODUCTION THEREOF

(75) Inventors: Jürgen Claus, Weinstadt (DE); Roberto De Zolt, Fellbach (DE); Reiner Heigl, Remseck (DE); Wolf Saeltzer, Böblingen (DE)

(73) Assignee: Daimler AG, Stuttgart (DE)

( * ) Notice: Subject to any disclaimer, the term of this patent is extended or adjusted under 35 U.S.C. 154(b) by 1039 days.

(21) Appl. No.: 10/579,432

(22) PCT Filed: Nov. 3, 2004

(86) PCT No.: PCT/EP2004/012412

§ 371 (c)(1),
(2), (4) Date: Aug. 6, 2006

(87) PCT Pub. No.: WO2005/046925

PCT Pub. Date: May 26, 2005

(65) Prior Publication Data

US 2007/0044304 A1 Mar. 1, 2007

(30) Foreign Application Priority Data

Nov. 15, 2003 (DE) ..... 103 53 474

(51) Int. Cl.

| | |
|---|---|
| ***B22D 19/00*** | (2006.01) |
| ***B23K 15/00*** | (2006.01) |
| ***B23P 11/00*** | (2006.01) |
| ***B23P 19/04*** | (2006.01) |

(52) U.S. Cl. ..... 29/888.06; 29/888.043; 29/402.18; 29/402.09; 123/193.5; 148/512; 148/549; 148/565; 219/121.65

(58) Field of Classification Search ..... 29/402.01, 29/402.07, 402.09, 402.16, 402.18, 888.04, 29/888.041, 888.043, 888.049, 888.06; 123/193.5; 148/512, 525, 549, 565; 219/76.11, 76.14, 219/121.65

See application file for complete search history.

(56) References Cited

U.S. PATENT DOCUMENTS

| | | | | |
|---|---|---|---|---|
| 4,157,923 | A * | 6/1979 | Yen et al. | 148/512 |
| 4,695,329 | A * | 9/1987 | Hayashi et al. | 148/549 |
| 4,772,340 | A * | 9/1988 | Kawaguchi et al. | 148/512 |
| 6,440,583 | B1 * | 8/2002 | Ueno et al. | 428/654 |

FOREIGN PATENT DOCUMENTS

| | | |
|---|---|---|
| DE | 718 437 | 3/1942 |
| DE | 1 122 325 | 1/1962 |
| DE | 36 05 519 A1 | 9/1986 |

(Continued)

*Primary Examiner*—David P Bryant
*Assistant Examiner*—Alexander P Taousakis
(74) *Attorney, Agent, or Firm*—Patent Central LLC; Stephan A. Pendorf

(57) ABSTRACT

Disclosed is an internal combustion engine component (1) which is made of an aluminum alloy and comprises at least one area (2) that is subjected to a great thermal load during operation of the internal combustion engine. Said area (2) that is subjected to a great thermal load is small compared to the entire component (1) and is provided with an alloy composition which is modified in relation to the entire component (1) in such a way that the area (2) that is subjected to a great thermal load has a greater breaking elongation than the entire component (1).

6 Claims, 1 Drawing Sheet

FOREIGN PATENT DOCUMENTS

| | | | |
|---|---|---|---|
| DE | 41 41 437 | C1 | 12/1992 |
| DE | 39 28 579 | C2 | 12/1993 |
| EP | 0 445 818 | A1 | 9/1991 |
| EP | 1 386 687 | A1 | 2/2004 |
| EP | 1 464 821 | A1 | 10/2004 |

* cited by examiner

INTERNAL COMBUSTION ENGINE COMPONENT AND METHOD FOR THE PRODUCTION THEREOF

CROSS-REFERENCE TO RELATED APPLICATION

This application is a national stage of PCT/EP2004/012412 filed Nov. 3, 2004 and based upon DE 103 53 474.1 filed on Nov. 15, 2003 under the International Convention.

BACKGROUND OF THE INVENTION

1. Field of the Invention

The invention concerns a component of an internal combustion engine of the generic type defined in greater detail hereinafter. The invention further concerns a process for production of a component of an internal combustion.

2. Description of Related Art

DE 199 02 884 A1 discloses a piston for an internal combustion engine with direct injection as well as a process for production thereof, in which the collar of the cavity edge is melted and an additive is supplied to the melt. The goal of this addition of additive is to increase the stiffness and temperature resistance of the piston in this area which is highly stressed thermally as well as mechanically, in order to be able to employ the piston in environments with higher temperatures and pressures.

Similar methods for producing a higher stability in a high stressed area are described in DE 1 122 325 A1, DE 2 124 595 A1, DE 28 35 332 C2 or DE 2 136 594 A1.

From EP 0 092 683 B1 or DE 199 12 889 A1 processes for production of valve seats are known, in which likewise one or more strength increasing additives are introduced into a molten area, in order to achieve higher hardness of this area.

The problem with many of these components, as well as the processes employed for manufacture thereof, is that with an increase in the stiffness, with to the accompanying increase in brittleness of the material, upon exposure to thermal loads or in the case of an overlap of thermal and purely mechanical loads formation of cracks can occur as a result of material fatigue. This applies in particular when a thermally high loaded area is also subjected, in addition to this thermal load, to strong temperature fluctuations, for example as a consequence of liquid cooling.

In accordance with the conventional state of the art, attempts have been made to solve the problem by improving the casting techniques and using a subsequent thermal treatment to set up a fine and stable as possible micro structure. These measures however influence the entire component, so that the above-described problems cannot be overcome thereby.

SUMMARY OF THE INVENTION

It is thus the task of the present invention to provide an aluminum alloy component of an internal combustion engine as well as a process for the production thereof, with which a failure of the component following exposure to high thermal loads or stresses can be avoided.

In accordance with this information, this task is solved as set forth below.

By the inventively modified alloy composition of the component, the thermally highly loaded area is changed in such a manner that this thermally highly loaded area exhibits a higher break elongation than the rest of the component. Thereby the component can endure higher stresses without damage in the thermally highly loaded area. As a result of the increased breaking elongation and the improved toughness at room temperature and at higher temperatures, the occurrence of possible material fatigue or, as the case may be, formation of cracks can be shifted to occur later in time or following higher loads. Thereby it is possible to produce combustion engines with higher power and/or an increased life expectancy.

By the inventive solution the rigidity of the component is only modified to the extent, that purely mechanical loads can have no negative influence on the component, since the totality of the component can be imparted with the strength necessary for the expected mechanical loads while an increased breaking elongation is necessary essentially only in the thermally highly loaded area. This is very important, for example, for the introduction of torque or bolt forces. With the known solutions and increase in the rigidity or stiffness always leads to a reduction in break elongation, whereby upon the occurrence of high bolt forces, it is unavoidable that material cracks or the like can be caused. In contrast to this, the inventive solution provides an optimal compromise of sufficient rigidity and high breaking elongation.

In this regard it is particularly advantageous if the thermally highly loaded area contains a greater aluminum content then the overall component.

In one component, in which the inventive solution can be employed in a particularly advantageous manner, this is a cylinder head. In a cylinder head the thermally highly stressed area is preferably in the intermediate area located between the respective valve bores.

The process for producing the inventive component is set forth in claim 7.

By the there described melting of the base material of the component and the addition of the additive, the alloy composition in this highly stressed area can be particularly precisely controlled. Regarding the inventive process, this could be referred to, in contrast to the conventional known state-of-the-art process, as a "dis-alloying" rather than an "up alloying".

BRIEF DESCRIPTION OF THE DRAWINGS

Further advantageous embodiments of the invention can be seen from the dependent claims. In the following an illustrative embodiment of the invention will be described in principle on the basis of the drawing.

There is shown in.

DETAILED DESCRIPTION OF THE INVENTION

Figure 1:
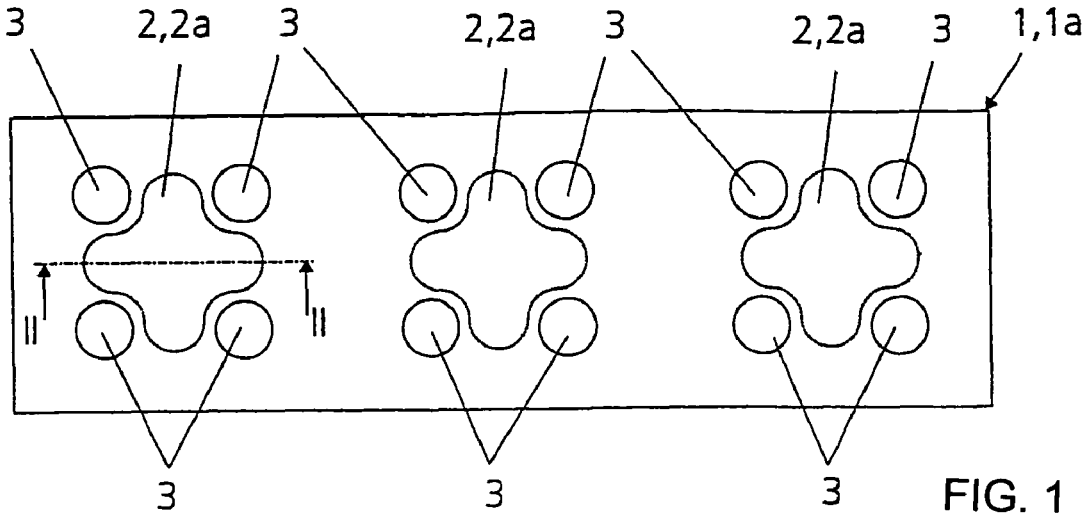
FIG. 1 a view of the separation surface of a cylinder head of an internal combustion engine.

FIG. 1 shows a component 1 of an internal combustion engine which engine is not shown in its entirety. The component 1 is in the present case a cylinder head 1*a*, which is comprised of an aluminum silicon alloy. The component 1 includes multiple thermally highly stressed areas 2. In the present case, these are the intermediate areas 2*a* located between the respective valve bores 3. Since the internal combustion engine associated with the cylinder head 1*a* includes three or, as the case may be, six cylinders, a total of three intermediate areas 2*a* are included. Since in this case four valve bores 3 are provided for each cylinder, the intermediate areas 2*a* are essentially in the shape of a cross. If two valve bores 3 were provided per cylinder, then the intermediate areas 2*a* could essentially be linear shaped. In each case the thermally highly stressed area 2 is relatively small in comparison to the total component 1.

In order to prevent formation of cracks in this highly thermally stressed area 2 during operation of the internal combustion engine due to material fatigue, these areas are subjected to the processes described in the following.

Figure 2:
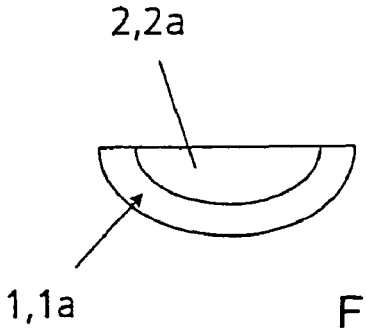
FIG. 2 a section through an intermediate area of the cylinder head according to Line II-II from FIG. 1 in a first condition.

In FIG. 2, the component 1 with the thermally highly stressed area 2, or as the case may be, base area 2*a* is shown in its untreated condition. Preferably the component 1 is produced by casting.

Figure 3:
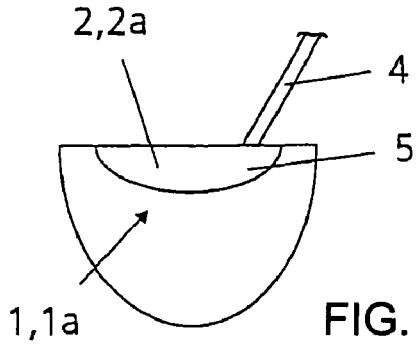
FIG. 3 an intermediate area of the cylinder head from FIG. 2 in a second condition.

According to the process step of FIG. 3, the thermally highly stress area 2 is heated by a beam or radiation process, and in the present case a laser beam 4 is employed. Thereby a melt pool 5 is produced in the thermally highly stressed area 2. Alternatively to the employment of the laser beam 4, an electron beam or the like could also be employed. Further, it would also be possible that the melt pool 5 is produced by means of a WIG-process, a plasma process or an another suitable mode and manner. Already as a result of the heating of the melt pool 5 in the thermally highly stressed area 2, a fine grain micro structure is produced after a rapid cooling, which leads to improved material characteristics, in particular an increase in the toughness or, as the case may be, breaking elongation.

Figure 4:
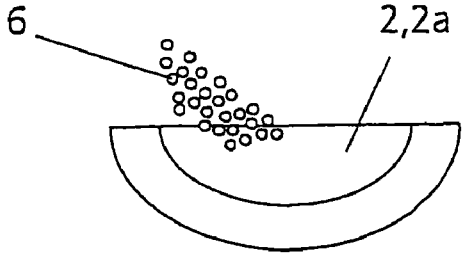
FIG. 4 the intermediate area of the cylinder head from FIG. 2 in a third condition.
Figure 5:
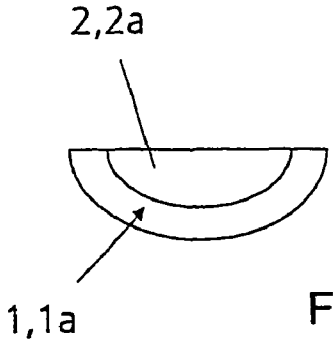
FIG. 5 the intermediate area of the cylinder head from FIG. 2 in a fourth condition.

Supplementally, as shown in FIG. 4, an additive 6 is introduced into the melt pool 5. This additive 6, which preferably includes a greater aluminum content than the component as a whole, can be added in the form of a powder or even in the form of a solid material into the melt pool 5. In order to achieve a particularly good compromise between sufficient strength and elevated break elongation, the additive 6 has a silicon component of 1-5 wt. %, a magnesium component of less than 0.25 wt. % and an iron component of less than 0.1 wt. %. Basically, the additive can also be a pure or nearly pure aluminum.

After the cooling of the thermally highly stressed area 2, of which the alloy composition has been modified in the above described mode and manner, there results a component 1, which is comprised in its totality of an aluminum alloy, which is adapted to the mechanical requirements with regard to strength, for example, as concerns the not shown bolt holes. In the thermally highly stressed area 2, the component 1 exhibits however an altered alloy composition, which leads thereto, that the thermally highly stressed area 2 exhibits a greater breaking elongation then the overall component 1. Due to the higher breaking elongation, there is produced an improved toughness within the thermally highly stressed area 2, of which the very good thermo-mechanical characteristics are improved thereby.

After the described change in the alloy composition of the thermally highly stressed area 2, the component 1 can of course be further mechanically processed in a known manner. The depth of the area 2 with the altered alloy composition is preferably 0.2 mm to 5 mm. In this context it is also possible to produce multiple melt pools 5 of different depths and thereby to introduce multiple levels or layers of the additive 6. Therewith the composition of the alloy 6 can be stepwise so modified, that a layered increase in the breaking elongation is produced in the direction towards the surface of the component 1. The size of the produced melt pool 5 is a product of the amount of the energy introduced into the component 1. Likewise, with regard to the coefficient of expansion, a gradient-like transition from area 1 to area 2 can be useful. Here the coefficient of expansion changes continuously.

We claim:

1. A process for producing an aluminum alloy component of an internal combustion engine, comprising:

determining an area (2) of the component (1), which is highly thermally stressed during operation of the internal combustion engine, forming a melt in said highly thermally stressed area (2) of the component (1), introducing an additive (6) into the melt (5), wherein said additive is an aluminum alloy with a component of 1-2 wt. % silicon, less than 0.25 wt. % magnesium and less then 0.1 wt. % iron, and cooling said melt, such that said highly thermally stressed area (2) has a higher aluminum content than the overall component (1) and exhibits a higher breaking elongation than the overall component (1).

2. A process according to claim 1, wherein the melting is carried out using a beam process.

3. A process according to claim 2, wherein said beam process involves a laser beam (4), a plasma beam or a WIG-process.

4. A process according to claim 1, wherein said component is a cylinder head (1*a*).

5. A process according to claim 4, wherein said thermally highly stressed area (2) is an intermediate area (2*a*) between respective valve bores (3).

6. A process according to claim 5, wherein the depth of the thermally highly stressed area (2) having the altered alloy composition is from 0.2 mm to 5 mm.

* * * * *